US006376165B1

(12) United States Patent
Ezure et al.

(10) Patent No.: US 6,376,165 B1
(45) Date of Patent: Apr. 23, 2002

(54) PREPARATION METHOD PHOTOTHERMOGRAPHIC MATERIAL

(75) Inventors: Hidetoshi Ezure; Kenji Ohnuma; Yuji Hosoi, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/663,350

(22) Filed: Sep. 15, 2000

(30) Foreign Application Priority Data

Sep. 17, 1999 (JP) ..... 11-264025

(51) Int. Cl.[7] ..... G03C 1/498; G03C 1/76

(52) U.S. Cl. ..... 430/617; 430/264; 430/533; 430/619; 430/935

(58) Field of Search ..... 430/619, 935, 430/533, 617, 264

(56) References Cited

U.S. PATENT DOCUMENTS 6,132,950 A * 10/2000 Ishigaki et al. ..... 430/619

FOREIGN PATENT DOCUMENTS

JP 10010676 * 1/1998

* cited by examiner

*Primary Examiner*—Thorl Chea
(74) *Attorney, Agent, or Firm*—Finnegan, Henderson Farabow, Garrett & Dunner, L.L.P.

(57) ABSTRACT

A method of preparing a photothermographic material, comprising a support having thereon at least a layer, the method comprising the steps of:

coating a coating solution containing an organic silver salt, a photosensitive silver halide and a reducing agent on the support to form a coated material and subjecting the coated material to a thermal treatment at a temperature of 40 to 120° C. under a tension of 0.01 to 30 kg/cm$^2$.

14 Claims, 1 Drawing Sheet

PREPARATION METHOD PHOTOTHERMOGRAPHIC MATERIAL

FIELD OF THE INVENTION

The present invention relates to a preparation method of a thermally developable photothermographic material and in particular to a photothermographic material exhibiting superior dimensional stability even after being thermally developed.

BACKGROUND OF THE INVENTION

There have been made a number of studies of the thermally processing process in which development is carried out by heating to form a black-and-white image or a color image. There are also known so-called transfer type photothermographic materials in which images obtained by thermal development are transferred to an image receiving layer from the photothermographic material. In photographic materials employing a thermal development system, development is usually carried out at a temperature of 80 to 150° C. and the dimensional change of the photographic material after being thermally developed is rather pronounced, compared to conventional wet-processed photographic materials, which produce problems in practical use.

Reduction of such marked dimensional change can be classified into two main methods. One of them is to enhance heat resistance of the photographic material and the other one is development of an image forming method to reduce a dimensional change during thermal processing.

Methods for enhancing heat resistance of photothermographic materials include, for example, a technique described in JP-A No. 10-10676 and 10-10677, in which a support is subjected to a thermal treatment while being transported at a high temperature of 80 to 200° C. and a low tensile force of 0.04 to 6 kg/cm$^2$ to lessen thermal shrinkage of the support, thereby reducing the dimensional change thereof. However, the thermal treatment under such a low tensile strength produced the thermal shrinkage of the support which is locally different, leading to deterioration of flatness of the support and fine abrasion marks caused by friction from the transport rollers, leading to lowered quality of the photothermographic material.

With regard to the image forming method of photothermographic materials, a number of techniques prescribing temperature stability at the time of thermal development were disclosed, for example, as described in JP-A 9-292695, but there is not disclosed an image forming method reducing the dimensional change.

SUMMARY OF THE INVENTION

Accordingly, it is an object of the present invention to provide an image forming method of a photothermographic material exhibiting a reduced dimensional change after being thermally developed.

As a result of the inventors' study to solve the problems described above, it was found that when a photographic support was subjected to a thermal treatment under tension, varying the tensile force and preferably gradually reducing the tensile force resulted in reduction of the residual internal stress which was produced at the film-making stage of the support, for example, at the stage of stretching, leading to the support exhibiting lessened dimensional change and superior quality as exemplified by a flat surface of flatness.

Further, to prepare photothermographic materials, a solution containing an organic silver salt, photosensitive silver halide and a reducing agent is coated on a support and dried at a temperature of 40 to 80° C., while transporting the support under tension. In this case, it was found that controlling the transport tension resulted in reduced dimensional change. It was further found that in thermal processing of the photothermographic materials, adjusting physical properties of the photothermographic material, the pressure on the transporting medium and the matting degree of the transporting medium resulted in lessening of the dimensional change.

The object of the present invention can be accomplished by the following constitution:

a method for preparing a photothermographic material comprising on a support an organic silver salt, photosensitive silver halide and a reducing agent, the method comprising:

(i) coating a coating solution containing the organic silver salt, the photosensitive silver halide and the reducing agent on a support to form a coated material, while the support is in tension, and (ii) subjecting the coated material to a thermal treatment at a temperature of 40 to 120° C., wherein in step (ii), a tension of 0.01 to 30 kg/m$^2$ is applied to the support.

DETAILED DESCRIPTION OF THE INVENTION

Figure 1:
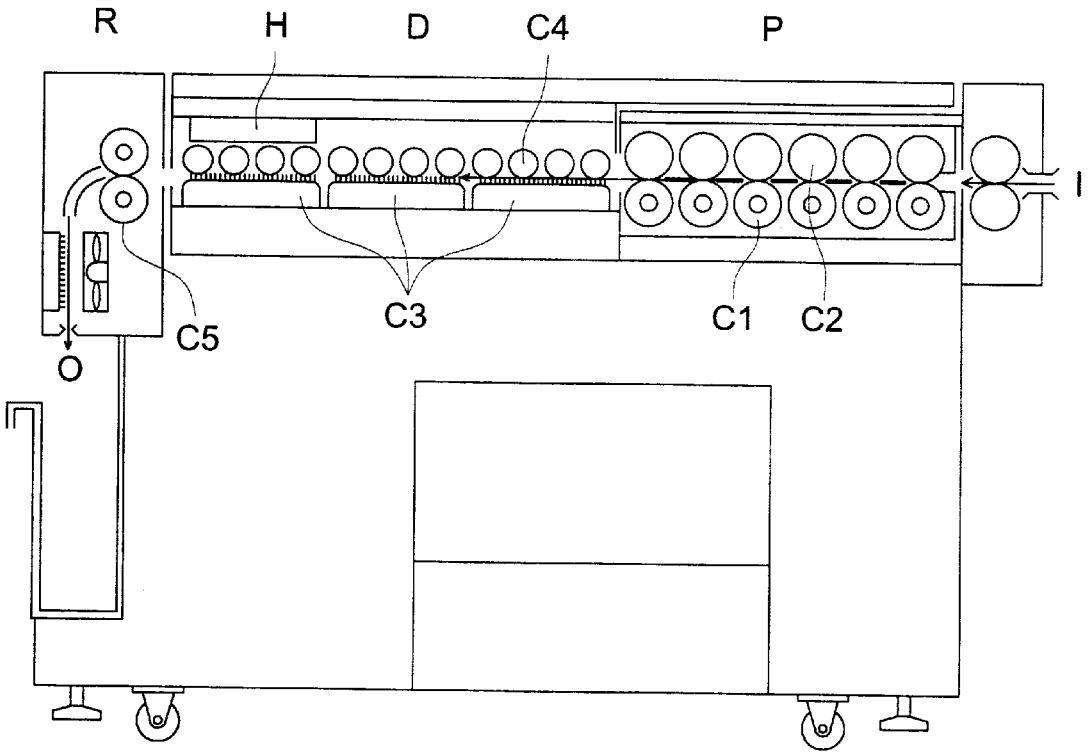
FIG. 1 illustrates a sectional view of a thermal processor used in this invention.

A preferred method of preparing a support used in this invention concerns a technique in which the support is subjected to thermal treatment at a temperature of not less than the glass transition temperature of the support and not more than the melting point of the support, while the support is being transported under tension. The level of tension applied to the support during the thermal treatment is desirable to be low to enhance effects of the thermal treatment, i.e., to lessen dimensional change during thermal processing of a photothermographic material, without retarding a progress of thermal shrinkage. However, in cases when the tension is too low, the thermal treatment results in non-uniform thermal shrinkage, leading to not only deteriorated flatness but also occurrence of fine abrasion marks caused by rubbing against the transport rollers. The tension during transporting is preferably 0.01 to 30 kg/m2, more preferably 6.0 to 20 kg/m$^2$, and still more preferably 6.0, to 10 kg/m$^2$. In this invention, the tension is defined as the tensile force applied to the support, divided by a sectional area (i.e., width×thickness) of the support.

It was found by the inventors of this invention that deterioration of flatness of the support could be prevented by varying the tension during transport, even when subjected to thermal treatment at a relatively low tension. It is presumed that differences in thermal shrinkage among various locations of the support and occurred during the thermal treatment, is relaxed. The tension during the thermal treatment may be varied vibratingly, stepwise, or continuously. The tension is preferably varied stepwise, or continuously, and more preferably continuously.

Continuously varying the transporting tension during thermal treatment is preferably conducted in such a manner that the tension at the start of the thermal treatment is larger than that at the finish of the thermal treatment and tension is gradually reduces from the start to the finish. A support which was thermally treated in such a manner exhibits improved dimensional change characteristics, even when thermally treated at a relatively low tension, and improved flatness was also achieved by varying tension during transport. Thereby, superior thermal dimensional change characteristics and superior flatness are achieved, leading to a support having both advantages.

The thermal treatment of the support is preferably conducted after thermal fixing of the support and before coating a solution containing an organic silver salt, phototosensitive silver halide and a reducing agent on the support. The thermal treatment time of the support can be regulated by varying the transport speed of the support of the length of a thermal treatment zone. the thermal treatment time, depending on the thermal treatment temperature, is preferably 0.2 to 30 min., and more preferably 0.5 to 15 min. The thermal treatment time within these range prevents deterioration in thermal dimensional stability, flatness-or transparency of the support, leading to suitability for photothermographic materials.

In cases where the transport tension is varied, the tension is varied preferably in the range of 0.01 to 30 kg/cm$^2$, more preferably 0.1 to 15 kg/cm$^2$, and still more preferably 1.0 to 7 kg/cm$^2$ in terms of flatness.

The method in which tension is gradually decreased during transport is also effective even in the process of cooling to room temperature after completing the thermal treatment described above. The reason for this effect is not necessarily clear but it is presumed that a support does not promptly lose its viscosity after being subjected to the thermal treatment and its tension contributes to the effect. This tension effect is related to a rate of cooling to room temperature, and the cooling rate is preferably 0.01 to 100° C./min, more preferably 0.1 to 50° C./min, and still more preferably 1.0 to 30° C./min.

Adjustment of the transport tension during the thermal treatment can be readily achieved by adjusting the torque of the reel roll and/or the delivery roll. Alternatively, a dancer roller is provided in the process and the tension can be adjusted by adjusting a load applied to the roller. In cases when varying the tension during the thermal treatment and/or during the cooling stage after the thermal treatment, a dancer roller is provided before and behind and/or within these processes and the intended tension can be obtained by adjusting the load applied to the roller. In cases when vibratingly varying the transport tension, it is effective to shorten the distance between thermal treatment rollers. The distance between rollers is 0.1 to 10 m, and preferably 0.1 to 5 m. A roll which is axially and slightly tapered from the center to the edges may be employed to enhance flatness of the support.

The thermal treatment is carried out at a temperature higher than the glass transition point and lower than the melting point. The thermal treatment is preferably carried out after thermal fixing and before coating the photosensitive layer. The glass transition point is determined as an average value between the temperature initiating to separate from the base line and a temperature returning to the base line in differential thermal analysis, and the melting point is represented as an endothermic peak temperature.

Photographic supports used in this invention are those which were previously subjected to the foregoing thermal treatment. An absolute value of the thermal dimensional change rate at 120° C. over a period of 30 sec. is preferably 0.01 to 0.08% in the longitudinal or machine direction (also denoted as MD-direction) and 0.01 to 0.04% in the transverse direction (also denoted as TD-direction), more preferably 0.01 to 0.06% in the MD-direction and 0.01 to 0.03% in the TD-direction, and still more preferably 0.01 to 0.04% in the MD-direction and 0.01 to 0.02% in the TD-direction.

The photographic supports relating to this invention may be comprised of any polymer. Examples of polymers superior in transparency and heat-resistant dimensional stability, used for thermally processable photothermographic materials include polyethylene terephthalate (PET), polyethylene naphthalate (PEN), polycarbonate (PC), polyether sulfones (PES), polyarylate (PAr), polyether etherketone ((PEEK), polysulfone (PSO), polyimide (PI), polyether imide (PEI), polyamide (PAm), polystyrene (PS), and syndiotactic polystyrene (SPS). Of these, a support substantially comprised of PET, PEN, PC or SPS is preferred, one substantially comprised of PET or PEN is more preferred, and one substantially comprised of PET is still more preferred in terms of cost. Herein, the expression, "one substantially comprised of" include not only a homopolymer but also a copolymers or a polymer blend, in which at least 50% by weight of the total constituting elements is accounted for by the polymer.

PET is comprised of terephthalic acid and ethylene glycol, which are bound with each other in the presence of a catalyst under the optimum conditions to form a polymer. In this case, at least an appropriate third component may be mixed in. The third component may be any divalent ester-forming functional group-containing compound, such as dicarboxylic acid compounds, including isophthalic acid, phthalic acid, 2,6-naphthalenedicarboxylic acid, 2,7-naphthalenedicarboxylic acid, diphenylsulfonedicarboxylic acid, diphenyletherdicarboxylic acid, diphenylethanedicarboxylic acid, cyclohexanedicarboxylic acid, diphenyldicarboxylic acid, diphenylthioetherdicarboxylic acid, diphenylketonedicarboxylic acid and phenylindanedicarboxylic acid. Examples of glycols include ethylene glycol, propylene glycol, tetramethylene glycol, cyclohexanedimethanol, 2,2-bis(4-hydroxyphenyl)propane, 2,2-bis(4-hydroxyethoxyphenyl)propane, bis(4-hydroxyphenyl) sulfones, bisphenolfluorenedihydroxyethylether, diethylene glycol, neopentylglycol, hydroquinone, and cyclohexanediol.

The intrinsic viscosity of PET is preferably 0.3 to 1.0, more preferably 0.4 to 0.8, and still more preferably 0.5 to 0.7. A mixture of plural PETs exhibiting different intrinsic viscosities may be used. In this case, the difference in intrinsic viscosity is 0.1 to 0.4, and preferably 0.15 to 0.3.

The synthesis method of the PET used in this invention is not specifically limited and it can be synthesized according to any of the methods known in the art. Examples thereof include a direct esterification method in which a dicarboxylic acid component and a diol component are directly subjected to esterification and also a transesterification method in which a dialkyl ester, as a dicarboxylic acid component and a diol component are subjected to ester interchange to undergo polymerization, while removing the excess diol component. In this case, a transesterification catalyst or polymerization catalyst is optionally employed and a heat stabilizer may be used. Example of such a heat stabilizer include phosphoric acid, phosphorous acid and their ester compounds. Adjuvants such as an anti-coloring agent, nucleating agent, lubricant, stabilizer, anti-blocking agent, UV absorbent, viscosity-adjusting agent, defoaming agent, antistatic agent, pH-adjusting agent, dye, and pigment may be added at any step in the synthesis process.

Next, a preparation method of photographic supports will be described. A method for obtaining an unstretched sheet or film and a method of uniaxially stretching in the longitudinal direction can be accomplished according to techniques known in the art. For example, polyester as a raw material is molded into a pellet form, after drying with hot air or under vacuum, it is extruded into a sheet form by melt extrusion and a T-die, and brought into close contact with a cooling drum by the electrostatic applying method to be solidified. An unstretched sheet obtained is heated at a temperature within a range of the glass transition point of the polyester (Tg) and Tg+100° C. through plural roller groups and/or infrared heaters and subjected to longitudinal stretching. The stretching magnification is usually 2.5 to 6 times. In this case, roll-set curl can be lessened by allowing a stretching temperature to differ between inside and outside. For example, in heating at the stage of longitudinal stretching, a heating means such as an infrared ray heater is provided on one side to control temperature. This temperature difference at the stage of longitudinal stretching is preferably 0 to 40° C., and more preferably 0 to 20° C. A temperature difference of more than 40° C. results in non-uniform stretching, leading to deteriorated flatness of the film.

The thus longitudinally stretched polyester film is further laterally stretched at a temperature of Tg to Tg+120° C. and then fixed. The magnification ratio of longitudinal stretching to lateral stretching is optimally adjusted so as to exhibit preferred characteristics by measuring physical properties of the thus obtained biaxially stretched film. Then, the film is thermally fixed at a temperature higher than the final lateral-stretching temperature and lower than Tg+180° C. over a period of 0.5 to 300 sec. It is preferred to carry out thermal fixing at two or more different temperatures. The film thus fixed at two or more different temperatures exhibits enhanced dimensional stability and is highly effective as a support used for thermally processable photothermographic materials.

The support used in this invention is preferably subjected to a relaxation treatment in terms of dimensional stability. It is preferred that the relaxation treatment is conducted after completion of thermal fixing in the stretching process of the polyester film, within a tenter for lateral stretching, or at the stage of reeling after coming out of the tenter. The relaxation treatment is carried out preferably at a temperature of 80 to 200° C., more preferably 100 to 180° C., and still more preferably 120 to 160° C. A relaxation rate is preferably 0.1 to 10%, and more preferably 2 to 6% with respect to the longitudinal and lateral directions. The support which has been subjected to the relaxation treatment is further subjected to the thermal treatment used in this invention to obtain a photographic support exhibiting a preferred thermal dimensional change.

The photographic support used in this invention is preferably provided with lubricity, thereby enhancing flatness and preventing abrasion marks. Means for providing lubricity is not specifically limited, but an external particle addition method in which inert inorganic particles are added, an internal particle precipitation method in which a catalyst added at the stage when polymerization is allowed to precipitate, and a method in which a surfactant is coated on the film surface are commonly known. Of these, the internal particle precipitation method in which precipitated particles can be regulated to a relatively small size is preferred to provide lubricity without deteriorating transparency.

The thickness of the support used in this invention is not limited but the thicker is more preferred in terms of dimensional change rate. In cases where used as photographic materials for medical diagnostic use, the thickness is preferably 90 to 200 μm, and more preferably 150 to 190 μm. In the case of photographic materials for graphic arts use, four color printers are simultaneously printed so that higher transparency is desired. In view thereof, the thickness is preferably 70 to 180 μm, and more preferably 100 to 140 μm.

With regard to haze in the support used in this invention, it is preferably not more than 3%, and more preferably not more than 1%. A haze of more than 3% makes images blurred when used in photographic materials for graphic arts use. The haze can be determined according to ASTM-D 1003-52.

Next, coating methods relating to this invention will be described. In cases where the photographic material relating to this invention is a thermally processable photothermographic material, a coating solution containing an organic silver salt, light sensitive silver halide and a reducing agent is coated and then dried and/or subjected to a thermal treatment at a temperature of 40 to 120° C. under a tension of 0.01 to 30 kg/cm$^2$. The drying and/or thermal treatment is carried out preferably at a temperature of 40 to 120° C., more preferably 50 to 100° C., and still more preferably 60 to 80° C. A excessively high temperature results in fogging and is commercially unsuitable. Further, a lower tension is also preferred as in the preparation of supports. The tension is preferably 1.0 to 20 kg/m$^2$, and more preferably 5 to 10 kg/m$^2$.

The thermal treatment time of the photothermographic material can be regulated by varying the transport speed of the support of the length of a thermal treatment zone. The thermal treatment time, depending on the thermal treatment temperature, is preferably 2 to 60 min., and more preferably 3 to 30 min. The thermal treatment time within these range prevents unevenness in drying, fogging or deterioration in flatness or transparency of the support. After completion of the thermal treatment, the tension applied is preferably less than that at the thermal treatment. In this case, the tension is gradually decreased to 0.01 to 6 kg/cm$^2$.

Coating systems include, for example, dip-coating, air-knife coating, flow coating and extrusion coating by use of a hopper. There are also applicable extrusion coating, slide coating and curtain coating described in S. F. Kister & M. Schwezer, LIQUID FILM COATING (published by Chapman & Hall, 1997) page 399–734. Further, two or more layers can be simultaneously coated according to the methods described in U.S. Pat. Nos. 2,716,179, 3,508,894, 2,941,898, 3,526,528 and Y. Harazaki "Coating Engineering" page 253 (published by Asakura Shoten, 1973).

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, arachidic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex with silver. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

Silver halide grains contained in the coating solution functions as a light sensor. Silver halide can be prepared by adding a halide component such as sodium bromide or ammonium bromide to the silver salt dispersion described above to convert a part of the organic silver salt to silver halide through halide conversion. However, it is preferred that silver halide is separately prepared according to conventional silver halide emulsion-making techniques, and thereby the size or form of silver halide grains can be readily controlled.

In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described below of less than 30%, and more preferably from 0.1 to 20%.

$$\text{Monodispersibility}=(\text{standard deviation of grain diameter})/(\text{average grain diameter})\times 100(\%)$$

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized. Furthermore, another preferred silver halide shape is a tabular grain. The tabular grain as described herein is a grain having an aspect ratio (AR), as defined below, of at least 3. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved. The composition of silver halide may be any of silver chloride, silver chlorobromide, silver iodochlorobromide, silver bromide, silver iodobromide, or silver iodide.

The halide composition of silver halide grains is not specifically limited and may be any one of silver chloride, silver chlorobromide, silver iodochlorobromide, silver bromide, silver iodobromide and silver iodide. Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964).

Silver halide preferably occludes ions of metals belonging to Groups 6 to 11 of the Periodic Table to improve intensity reciprocity failure or to adjust contrast. Preferred as the metals are W; Fe, Co, Ni, Cu, Ru, Rh, Pd, Re, Os, Ir, Pt and Au.

In general, formed silver halide grains are subjected to desalting to remove soluble salts by a noodle washing method or flocculation method; however, silver halide grains used in the invention may be or may be not subjected to desalting.

Silver halide grains used in the photothermographic materials relating to the invention are preferably be subjected to chemical sensitization. As is commonly known in the art, the chemical sensitization includes, for example, sulfur sensitization, selenium sensitization, tellurium sensitization. There are also applicable in the invention noble metal sensitization with gold compounds or platinum, palladium or iridium compounds, or reduction sensitization.

To prevent hazing of the photosensitive material, the total amount of silver halide and organic silver salt is preferably 0.5 to 2.2 g in equivalent converted to silver per $m^2$, leading to high contrast images. The amount of silver halide is preferably not more than 50% by weight, more preferably not more than 25% by weight, and still more preferably 0.1 to 15% by weight, based on total silver.

Commonly known reducing agents are used in thermally developable photothermographic materials, including phenols, polyphenols having two or more phenols, naphthols, bisnaphthols, polyhydoxybenzenes having two or more hydroxy groups, polyhydoxynaphthalenes having two or more hydroxy groups, ascorbic acids, 3-pyrazolidones, pyrazoline-5-ones, pyrazolines, phenylenediamines, hydroxyamines, hydroquinone monoethers, hydrooxamic acids, hydrazides, amidooximes, and N-hydroxyureas. Further, exemplary examples thereof are described in U.S. Pat. Nos. 3,615,533, 3,679,426, 3,672,904, 3,51,252, 3,782,949, 3,801,321, 3,794,488, 3,893,863, 3,887,376, 3,770,448, 3,819,382, 3,773,512, 3,839,048, 3,887,378, 4,009,039, and 4,021,240; British Patent 1,486,148; Belgian Patent 786,086; JP-A 50-36143, 50-36110, 50-116023, 50-99719, 50-140113, 51-51933, 51-23721, 52-84727; and JP-B 51-35851.

Of these reducing agents, in cases where fatty acid silver salts are used as an organic silver salt, preferred reducing agents are polyphenols in which two or more phenols are linked through an alkylene group or a sulfur atom, specifically, polyphenols in which two or more phenols are linked through an alkylene group or a sulfur atom and the phenol(s) are substituted at least a position adjacent to a hydroxy group by an alkyl group (e.g., methyl, ethyl, propyl, t-butyl, cyclohexyl) or an acyl group (e.g., acetyl, propionyl). Examples thereof include polyphenols compounds such as 1,1-bis(2-hydroxy-3,5-dimethylphenyl)-3,5,5-trimethylhexane, 1,1-bis(2-hydroxy-3-t-butyl-5-methyphenyl)methane, 1,1-bis(2-hydroxy-3,5-di-t-butylphenyl)methane, 2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3,5-di-t-butylphenyl)propane, as described in U.S. Pat. Nos. 3,589,903 and 4,021,249, British Patent 1,486,148, JP-A 51-51933, 50-36110 and 52-84727 and JP-B 51-35727; bisnaphthols described in U.S. Pat. No. 3,672,904, such as 2,2'dihydoxy-1,1'-binaphthyl, 6,6'-dibromo-2,2'-dihydroxy-1,1'-binaphthyl, 6,6'-dinitro-2,2'-dihydroxy-1,1'-binaphtyl, bis(2-hydroxy-1-naphthyl)methane, 4,4'-dimethoxy-1,1'-dihydroxy-2,2'-binaphthyl; sulfonamidophenols or sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The amount of the reducing agent to be used in the thermally developable photothermographic material, depending on the kind of an organic silver salt or reducing agent is preferably 0.05 to 10 mol, and more preferably 0.1 to 3 mol per mol of organic silver salt. Two or more kinds of reducing agents may be used in combination within the amount described above. It is also preferred to add the reducing agent to a photosensitive coating solution immediately before coating, in terms of reduced variation in photographic performance occurred during standing.

The photothermographic material used in the invention contains hydrazine derivatives. Preferred hydrazine derivatives are represented by the following formula (H):

Formula (H)

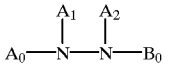

In the formula, $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)—, —SO—, —$SO_2$— or —P(O)($G_1D_1$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group, alkylthio group or arylthio group.

In Formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfooxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ of formula (H) is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. In the —$G_0$—$D_0$ group represented by $A_0$, $G_0$ is a —CO—, —COCO—, —CS—, —C(=$NG_1D_1$)—, —SO—, —$SO_2$— or —P(O)($G_1D_1$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group, alkylthio group or arylthio group, and preferred $D_0$ is a hydrogen atom, or an alkyl, alkoxyl or amino group. The aromatic group, heterocyclic group or —$G_0$—$D_0$ group represented by $A_0$ each may be substituted. Specifically preferred $A_0$ is an aryl group or —$G_0$–$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylpheoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably —$G_0$—$D_0$, wherein $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other.

$D_0$ is an aliphatic group, aromatic group, heterocyclic group, amino group, alkoxy group or mercapto group, and preferably, a hydrogen atom, or an alkyl, alkoxyl or amino group.

$A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxalyl).

A compound represented by formula [H] is exemplified as below, but the present invention is not limited thereto.

H-1
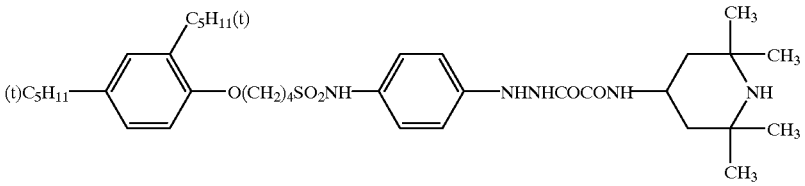
H-2
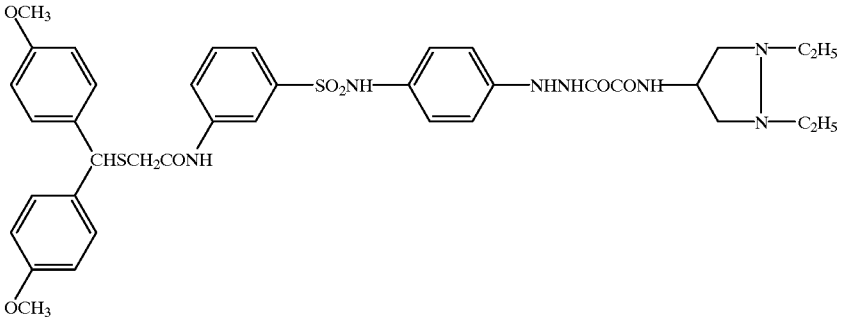
H-3
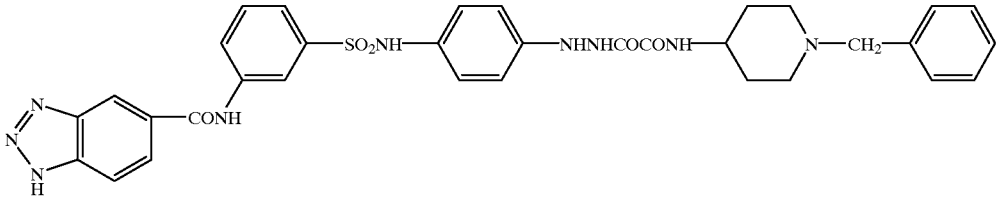
H-4
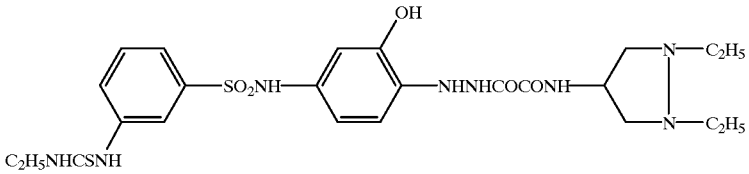
H-5
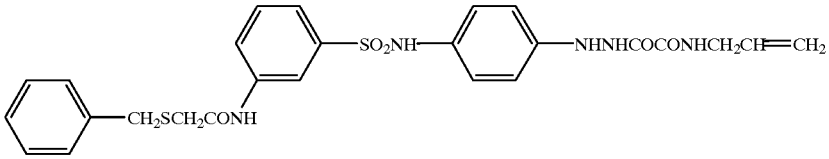
H-6
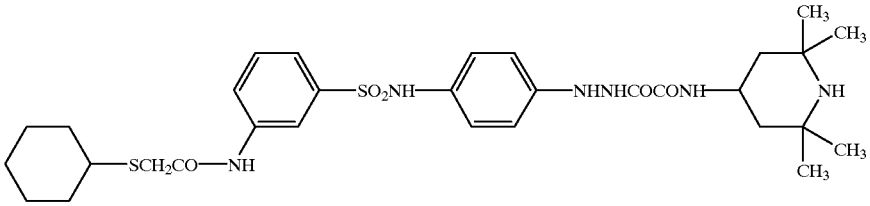
H-7
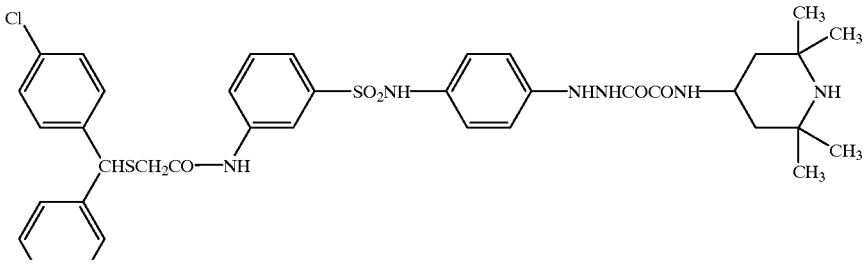

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11.

These hydrazine derivatives can be synthesized in accordance with commonly known methods. The hydrazine derivative is incorporated into a photosensitive layer containing a silver halide emulsion and/or a layer adjacent thereto. The amount to be incorporated, depending of a silver halide grain size, halide composition, a degree of chemical sensitization and the kind of an antifoggant, is preferably $10^{-6}$ to $10^{-1}$, and more preferably $10^{-5}$ to $10^{-2}$ mole per mole of silver halide.

In thermally developable photothermographic materials used in this invention, there can be employed techniques described in, for example, D. Morgan and B. Shely "Dry Silver Photographic Material", in U.S. Pat. Nos. 3,152,904 and 3,457,075; and in D. H. Klosterboer "Thermally Processed Silver Systems" (Imaging Processes and Materials) Neblette, 8th Edition, edited by Sturge, V. Walworth, and A. Shepp, page 279, 1989), etc. The photothermographic material is thermally developed preferably at a temperature of 80 to 140° C. to form images, without fixing.

It is preferred to incorporate to the photothermographic material a contrast increase promoting agent (or nucleation promoting agent), including hydroxylamine compounds, alkanolamine compounds and ammonium phthalate compounds described in U.S. Pat. No. 5,545,505; hydroxamic acid compounds described in U.S. Pat. No. 5,545,507; N-acyl-hydrazine compounds described in U.S. Pat. No. 5,558,983; acrylonirile compounds described in U.S. Pat. No. 5,545,515; hydrogen atom donor compounds such as benzhydrol, diphenylphosphine, dialkylpiperidine or alkyl-β-ketoester described in U.S. Pat. No. 5,545,515. of these are preferred a quaternary onium compound represented by the following formula (P) and an amino compound represented by the following formula (Na):

Formula (P)

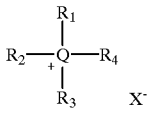

wherein Q is a nitrogen atom or a phosphorus atom; $R_1$, $R_2$, $R_3$ and $R_4$ are each a hydrogen atom or a substituent; $X^-$ is an anion, provided that $R_1$ to $R_4$ may be linked together with each other to form a ring;

Formula (Na)

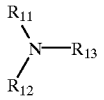

wherein $R_{11}$, $R_{12}$, and $R_{13}$ are each a hydrogen atom, an alkyl group, a substituted alkyl group, an alkenyl group, an a substituted alkenyl group, an alkynyl group, an aryl group, a substituted aryl group, saturated or unsaturated heterocyclic group, provided that $R_{11}$, $R_{12}$ and $R_{13}$ may be linked together with each other to form a ring. In this case, $R_{11}$, $R_{12}$, and $R_{13}$ are not hydrogen atoms at the same time. Specifically, an aliphatic tertiary amine compound is preferred. These compounds preferably contain a non-diffusible group or a group for promoting adsorption to silver halide. As the non-diffusible group is preferable a ballast group having a molecular weight of at least 100, and more preferably at least 300, including the ballast groups as defined in $A_0$ of formula (H).

The group for promoting adsorption to silver halide includes a heterocyclic ring, mercapto group, thione group, and thiourea group.

Further preferred nucleation promoting agent is represented by the following formula (Na2):

Formula (Na2)

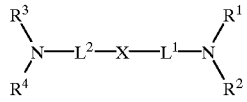

Wherein $R^1$, $R^2$, $R^3$ and $R^4$ are each a hydrogen atom, an alkyl group, substituted alkyl group, an alkenyl group, an a substituted alkenyl group, an alkynyl group, an aryl group, a substituted aryl group, saturated or unsaturated heterocyclic group, and these group may be linked together with each other to form a ring, provided that $R^1$ and $R^2$, or $R^3$ and $R^4$ are not hydrogen atoms at the same time; and X is S, Se or Te. $L_1$ and $L_2$ are each a linkage group and exemplary examples thereof include:

—$CH_2$—, —CH═CH—, —$C_2H_4$—, pyridine-di-yl, —N($Z_1$)—, —O—, —S-, —(CO)—, —($SO_2$)— and —$CH_2O$—, in which $Z_1$ is a hydrogen atom, an alkyl group or an aryl group and these groups each may be substituted.

The linkage group represented by $L_1$ and $L_2$ preferably contain at least one of the following structures:

—[$CH_2CH_2O$]—, —[C($CH_3$)$HCH_2O$]—, —[OC($CH_3$)$HCH_2O$]— and —[$OCH_2C(OH)HCH_2$]—

Exemplary examples of the nucleation promoting agents represented by formula (Na) or (Na2) are shown below, but are not limited to these.

Na-1

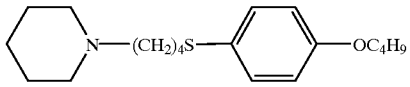

Na-2

$[(C_3H_7)_2N(CH_2)_3OCH_2CH_2]_2S$

Na-3

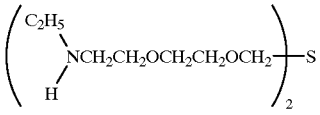

Na-4

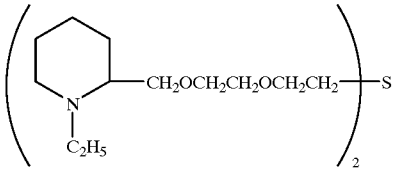

Na-5

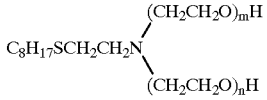

m + n = 20

-continued

Na-6

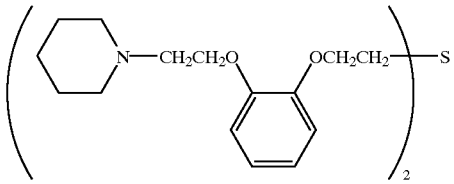

Na-7

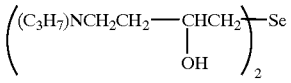

Na-8

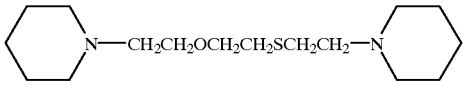

Na-9

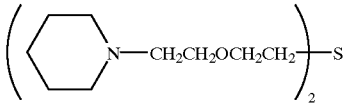

Na-10

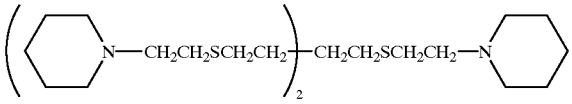

Na-11

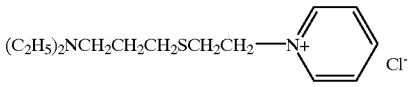

Na-12

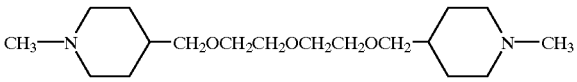

Na-13

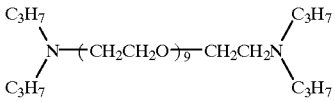

Na-14

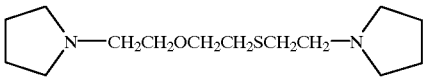

Na-15

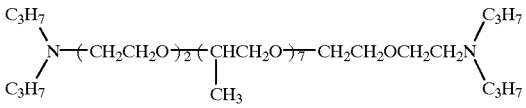

Na-16

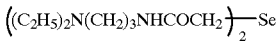

Na-17

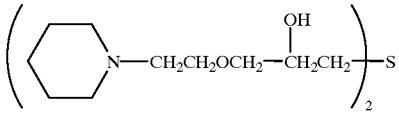

Na-18

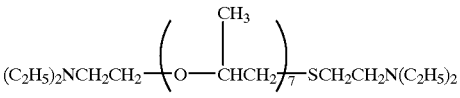

-continued

Na-19

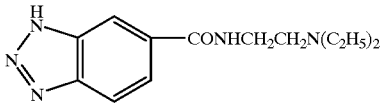

Na-20

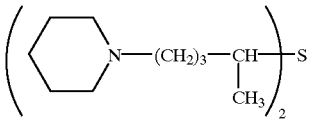

Na-21

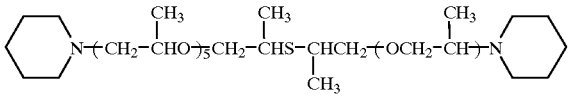

Na-22

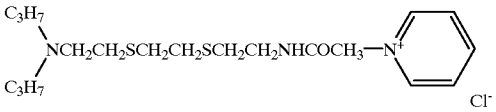

In formula (P), substituents represented by $R_1$ through $R_4$ include an alkyl group (e.g., methyl, ethyl, propyl, butyl, hexyl, cyclohexyl), an alkenyl group (e.g., allyl, butenyl), an alkynyl group (e.g., propargyl, butynyl), an aryl group (e.g., phenyl, naphthyl), a heterocyclic group (e.g., piperidyl, piperazyl, morpholyl, pyridyl, furyl, thienyl, tetrahydrofuryl, tetrahydrothienyl, sulfolanyl) and amino group. Examples of the ring formed by linking of $R_1$ through $R_4$ include a piperidine ring, morpholine ring, piperazine ring, quinuclidine ring, pyridine ring, pyrrole ring, imidazole ring, and tetrazole ring. The group represented by $R_1$ through $R_4$ may be substituted by a substituent, such as a hydroxy group, alkoxyl group, aryloxy group, carboxy group, sulfo group, alkyl group and aryl group. $R_1$, $R_2$, $R_3$ and $R_4$ are preferably a hydrogen atom or an alkyl group. Anions represented by X— include inorganic or organic anions such as halide ion, sulfate ion, nitrate ion, acetate ion, and p-toluenesulfonate ion.

More preferred compounds are represented by the following formulas (Pa), (Pb) and (Pc) or formula (T):

Formula (Pa)

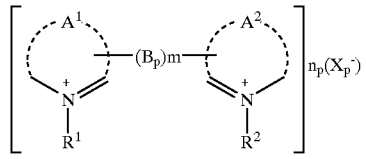

Formula (Pb)

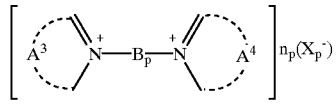

Formula (Pc)

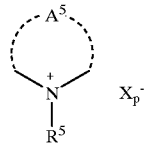

Wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted.

$X_p^-$ is a counter ion necessary to counterbalance overall charge of the molecule, such as chloride ion, bromide ion, iodide ion, sulfate ion, nitrate ion and p-toluenesulfonate; $n_p$ is a counter ion necessary to counterbalance overall charge of the molecule and in the case of an intramolecular salt, $n_p$ is 0.

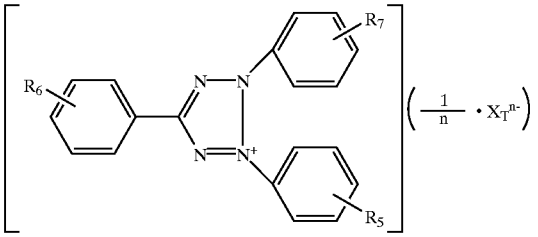

In formula (T), substituent groups $R_5$, $R_6$ and $R_7$, substituted on the phenyl group are preferably a hydrogen atom or a group, of which Hammett's σ-value exhibiting a degree of electron attractiveness is negative.

The σ values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative σ-values include, for example, methyl group ($\sigma_p$=−0.17, and in the following, values in the parentheses are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by $X_T^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkysulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

Exemplary examples of the quaternary onium compounds are shown below, but are not limited to these.

P-1

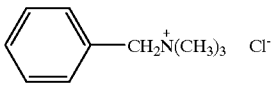

P-2

$C_{16}H_{33}\overset{+}{N}(CH_3)_3$ $Br^-$

P-3

$\overset{+}{N}(C_4H_9)_4$ $Cl^-$

P-4

$(CH_3)_3\overset{+}{N}CH_2CH_2OH$ $Cl^-$

P-5

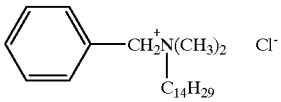

P-6

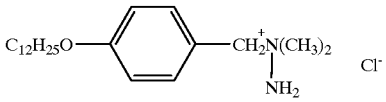

P-7

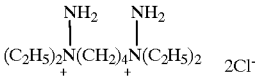

P-8

$(C_4H_9)_3\overset{+}{N}CH_2CH_2\overset{+}{N}(C_4H_9)_3$ $SO_4^{2-}$

-continued
P-9
$(C_2H_5)_3\overset{+}{N}(CH_2)_8\overset{+}{N}(C_2H_5)_3$ $2Cl^-$
P-10
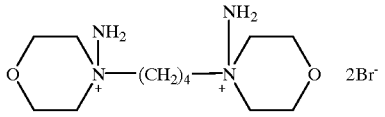
P-11
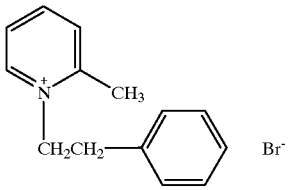
P-12
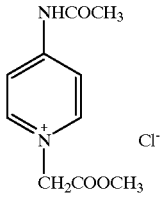
P-13
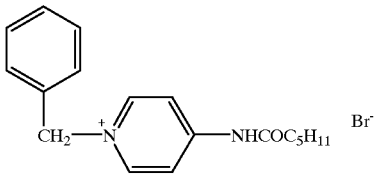
P-14
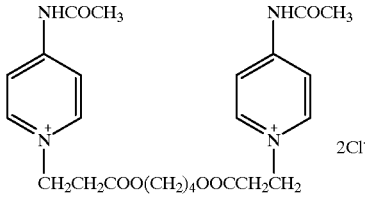
P-15
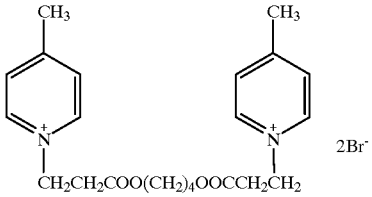
P-16
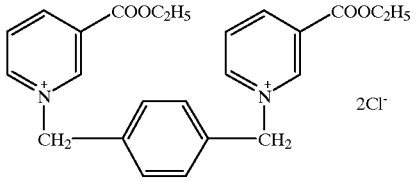
P-17
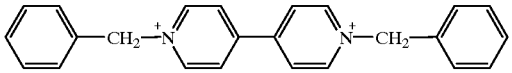
P-18
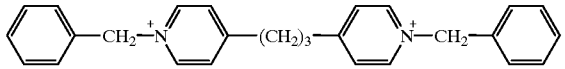
P-19
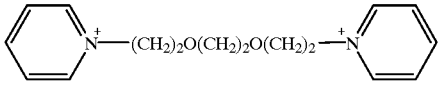
P-20
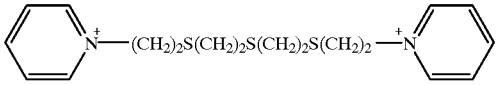
P-21
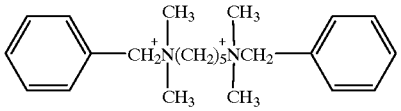
P-22
$(CH_3)_3\overset{+}{N}(CH_2)_2SS(CH_2)_2\overset{+}{N}(CH_3)_3$ $2CH_3$ 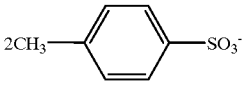
P-23
$(CH_3)_3\overset{+}{N}(CH_2)_2S(CH_2)_2S(CH_2)_2S(CH_2)_2\overset{+}{N}(CH_3)_3$
$2CH_3$ 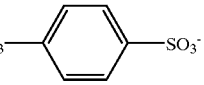
P-24
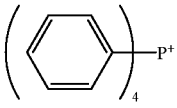
P-25
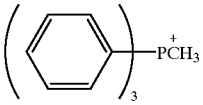
P-26
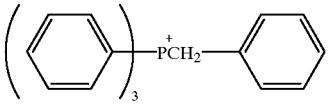
P-27
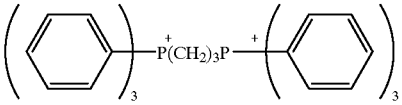
P-28
$(C_4H_9)_3\overset{+}{P}C_{16}H_{33}$ $Br^-$

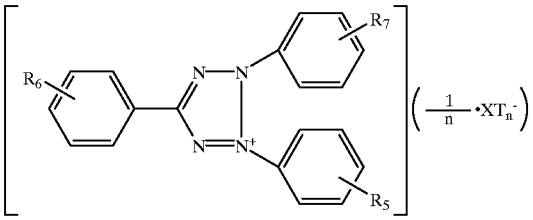

| Compd. No. | $R_5$ | $R_6$ | $R_7$ | $X_T^{n-}$ |
|---|---|---|---|---|
| T-1 | H | H | p-$CH_3$ | — |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | P-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The quaternary onium compounds described above can be readily synthesized according to the methods commonly known in the art. For example, the tetrazolium compounds described above may be referred to Chemical Review 55, page 335–483.

The quaternary onium compound is incorporated preferably. in an amount of $1\times10^{-8}$ to 1 mole, and $1\times10^{-7}$ to $1\times10^{-1}$ mole per mole of silver halide, which may be incorporated to a photothermographic material at any time from during silver halide grain formation and to coating.

The quaternary onium compound and the amino compound may be used alone or in combination. These compounds may be incorporated into any component layer of the photothermographic material, preferably a component layer provided on the photosensitive layer-side, and more preferably a photosensitive layer and/or its adjacent layer.

Binders suitable for the photothermographic material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinylpyrrolidone), casein, starch, poly(acrylic acid), poly(methylmethacrylic acid), poly(vinyl chloride), poly(methacrylic acid), copoly (styrene-maleic acid anhydride), copoly(styrene-acrylonitrile), copoly(styrene-butadiene), poly(vinyl acetal) series (for example, poly(vinyl formal)and poly(vinyl butyral), poly(ester) series, poly(urethane) series, phenoxy resins, poly(vinylidene chloride), poly(epoxide) series, poly (carbonate) series, poly(vinyl acetate) series, cellulose esters, poly(amide) series. These may be hydrophilic or hydrophobic polymers. Of these, as a binder preferable for the thermally developable photosensitive layer is polyvinyl acetals and more preferably polyvinyl butyral. Cellulose esters exhibiting higher softening temperature, such as triacetyl cellulose or cellulose acetatebutylate are preferred for non-photosensitive layers such as an over-coat layer or sub-coat layer, specifically, a protective layer or backing layer. The amount of a binder in a photosensitive layer is preferably 1.5 to 6 g/$m^2$, and more preferably 1.7 to 5 g/$m^2$. The amount of less than 1.5 g/m2 results in an increase density of an unexposed area to levels unacceptable to practical use.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169. The shape of the matting agent may be crystalline or amorphous. However, a crystalline and spherical shape is preferably employed.

In the photothermographic material used in this invention, there may be provided, on a support, an image forming layer alone, but at least a non-image forming layer is preferably provided on the image forming layer. To control the amount or wavelength distribution of light passing through the image forming layer, there may be a filter dye layer on the image forming layer-side or an anti-halation dye layer, so-called backing layer on the opposite side. A dye or pigment may be incorporated to the image forming layer. The non-image forming layer may contain the binder or matting agent described above, or lubricants such as a polysiloxane compound or liquid paraffin.

Various types of surfactants can be employed as a coating aid in the photothermographic material used in this invention. Specifically, fluorinated surfactants are preferably employed to improve an antistatic property or to prevent dot-like coating troubles.

The photosensitive layer may be comprised of plural layers, which may be arranged in the form such as high-speed layer/low-speed layer or low-speed layer/high-speed layer to adjust contrast. Suitable image tone modifiers are exemplarily described in RD17029. Mercapto compounds, disulfide compounds and thione compounds may be incorporated the photothermographic materials for the purpose of retarding or accelerating development, enhancing spectral sensitization efficiency or improving storage stability of unprocessed or processed photothermographic materials. There may be incorporated anti-foggant to the photothermographic materials. Various addenda may be incorporated to any one of a photosensitive layer, a light-insensitive layer and other component layers. For example, various surfactants, antioxidants, stabilizer, plasticizer, UV absorbent, or coating aid may be used. As these addenda and other adjuvants described above, compounds described in RD17029 (June 1978, page 9–15) are preferably employed.

A thermal image-forming process relating to this invention will be described. The photothermographic materials relating to this invention are thermally processed preferably using a thermal processor. In general, photothermographic materials are more subject to influence of temperature fluctuation in its heat-developing section, easily causing non-uniform development. Accordingly, there are employed a heated drum type automatic thermal processor described in JP-A 9-297384, 9-297385 and 9-297386, and a plain transport type automatic thermal processor described in WO98/27458. Specifically, photothermographic materials for graphic arts use are preferably processed using a plain transport type thermal processor to enhance dimensional stability. Further, an automatic thermal processor is also preferably employed, in which a pre-heating section is provided before the heat-developing section and the pre-heating temperature is 80 to 120° C. Pre-heating, which promotes development and reduces density unevenness, is effective in improving scanning unevenness. It is also preferred to conduct thermal processing by the use of an apparatus in which a photothermographic material is transported while one side of the photothermographic material is brought into close contact with a fixed heating body while pressing down on the other side by plural rollers, as described in JP-A 11-133572.

In the thermal image-forming process relating to this invention, the pressure of a transporting medium onto a photothermographic material is preferably 0.1 kgf/cm$^2$ to 10 kgf/cm$^2$. Herein, the transporting medium refers to a roll or belt used in the transport or thermal processing. When the pressure exceeds 10 kgf/cm$^2$, the photothermographic material is deformed or shrinkage or elongation of the photothermographic material occurs even if no deformation occurs, resulting in increased dimensional change. In the case of being less than 0.1 kgf/cm$^2$, the thermal development efficiency is lowered and the developing time is prolonged. A pressure within such a range as described above can be achieved by controlling the rotation speed or torque of a transport roll or belt or by improving quality of material on the surface or the shape thereof. In the case of controlling the rotation speed or torque of a transport roll or belt, a rotation speed or torque must be applied within a range to result in no transport trouble, and the gap for the photothermographic material or the line-speed must be set to a certain range. In this case, the line-speed is preferably 1260 to 3000 mm/min. A line-speed of less than 1260 mm/min causes development unevenness, and that of more than 3000 mm/min often causes transport troubles since the photothermographic material is softened in the heat-developing section. The pressure of the transport medium can be regulated by adjusting the spring force of the nip member connected to the transport roll. Such pressure of the transporting medium onto the photographic material can be measured by allowing Pre-scale (available from Fuji Photo Film Co.) to pass through a thermal processor.

The thermal processor used in this invention is preferably provided with a pre-heating section within the heat-developing section. Preheating the photothermographic material prior to heat-development leads to enhanced uniformity in heat-developing and reduction in dimensional change. Pre-heating is carried out preferably at a temperature of 40 to 100° C. The duration (or path time) in the pre-heating section is preferably 3 to 90 sec, and more preferably 5 to 30 sec. An excessively long path time lowers working efficiency, therefore, the shorter time is more preferred and the afore-memtioned time is reasonable in terms of heating members and energy cost.

The transport medium arranged in the thermal process preferably has a roughened surface. Thus, the surface of the transport medium preferably exhibits a matting degree of not less than 200 mmHg at 120° C. In cases when the matting degree at 120° C. is less than 200 mmHg, a photothermographic material is brought into contact with a heated transport medium to an excessive extent and the photothermographic material is deformed or shrinkage or elongation of the photothermographic material occurs even if no deformation occurs, resulting in increased dimens ional change. A matting degree within such a range as described above can be achieved by improving quality of surface material or by converting the surface, according to the following procedure. In the case of the surface exhibiting little roughness, such as a metal roll, roughness is further provided or sliding agents (e.g., fine part icles of silica, carbon black or cross-linked polymers, glass fiber, polyester or nylon fiber); (2) embossing is applied to the surface to provide roughness. (3) In the case of the surface being roughened, such as a rubber belt, organic or inorganic fine particles (e.g., polymer beads such as cross-linked polystyrene or cross-linked polymethyl methacrylate, inorganic oxide compounds such as silica or alumina) are compounded to enhance lubricity, in amounts causing no transport trouble. Herein the matting degree is defined as a degree of vacuum in equilibrium when a hollow metallic barrel is placed on the surface of a transport medium in an atmosphere at 23° C. and 55% RH and the inside thereof is forced to be evacuated by mean of a evacuation pump. A thermal conductivity of the thus treated surface material of a transport medium is preferably 0.2 to 1.0 W/m·K to enhance uniformity in temperature. A resistivity of the surface is preferably $10^0$ to $10^{12}\Omega$, and more preferably $10^0$ to $10^8\Omega$ for the purpose. of electrostatic charge prevention.

Effects of the matting degree of the transport medium surface can be further enhanced by allowing the photographic material to meet the following physical properties: (A) a matting degree of 35 to 200 mmHg, (B) a coefficient of dynamic friction of not more than 0.50 and (C) an indentation hardness of not less than 15.

The photothermographic material must meet the physical properties with respect to both image forming-side and backing side. To achieve (A), it is preferred to incorporate a matting agent into a binder. The amount of a matting agent is preferably 0.5 to 30% by weight, based on the total binder of the layer to be incorporated. Matting agents include organic and inorganic ones. Examples of inorganic material used as a matting agent include silica described in Switzerland Patent No. 330,158, glass powder described in French Patent No. 1,296,995, and carbonates of alkaline earth metals, cadmium and zinc. Examples of organic material used as a matting agent include starch described in U.S. Pat. No. 2,322,037, starch derivatives described in Belgian Patent No. 625,451 and British Patent No. 981,198, polyvinyl alcohol described in JP-B No. 44-3643, polystyrene and polymethacrylate described in Switzerland Patent No. 330,158, polyacrylonitrile described in U.S. Pat. No. 3,079,257, and polycarbonate described in U.S. Pat. No. 3,022,169. Any form of a matting agent is usable, including regular and irregular forms, and a regular form, such as a spherical form is preferred. The particle size of a matting agent is preferably 0.5 to 10 $\mu$m, and more preferably 1.0 to 8.0 $\mu$m. A coefficient of variation of particle distribution is preferably not more than 50%, more preferably not more than 40%, and still more preferably not more than 30%. With regard to a method for incorporating a matting agent, a matting agent may be dispersed in a coating solution and coated. Alternatively, a mating agent may be sprayed onto a coated layer and dried. In cases where plural matting agents are used, both methods may be employed in combination.

Lubricants are preferably incorporated to achieve (B). Examples of lubricants include silicone type lubricants described in U.S. Pat. No. 3,042,522, British Patent No. 955,061, U.S. Pat. Nos. 3,080,317, 4,004,927, 4,047,958 and 3,489,567, and British Patent 1,143,118; higher fatty acid type lubricants described in U.S. Pat. Nos. 2,454,043, 2,732,305, 2,976,148 and 3,206,311, German Patent 1,284,295 and 1,284,294; alcohol type and acid amide type lubricants; metal soaps described in British Patent No. 1,263,722, and U.S. Pat. No. 3,933,516; and ester toe and ether type lubricants described in U.S. Pat. Nos. 2,588,765 and 3,121,060, and British Patent 1,198,387. The coefficient of dynamic friction of a photothermographic material is obtained according to the manner that a photothermographic material is aged in an atmosphere of 23° C. and 55% RH and a coefficient of friction is measured between the surface of a transport medium and either an image forming layer side or backing layer side of the photothermographic material. Thus, the photothermographic material sheet is fixed on the planar table and further thereon, a material used in the surface of a transport medium is placed at a load of 200 g and moved at a constant speed. The coefficient of dynamic friction was determined as the load applied during movement.

There is no specific limitation to achieve (C) but the use of a binder exhibiting a high glass transition point (Tg) is preferable, and after coating binder, it is specifically preferred to subject the coat to a thermal treatment. Examples of the binder exhibiting a high Tg include polyvinyl butyral, cellulose acetate, cellulose acetate-butyral, polyester, polycarbonate, acryl resin, and polyurethane. Of these, polyvinyl butyral, cellulose acetate and cellulose acetate-butyral are preferred. The thermal treatment is carried out preferably at a temperature of 40 to 120° C., and more preferably 60 to 100° C.

When measured using material characteristics evaluation system of minute surface MZT-3 (available from Akashi Corp.) in an atmosphere of 23° C. and 55% RH according to the following conditions, the indentation hardness is defined as below:

$$\text{Indentation hardness} = 2.97 \times \text{test load}/(\text{maximum indentation depth})^2$$

Measurement condition:

indenter indenting mode, Indenting load of 3 gf, loaded speed of 3 gf/sec, holding time of 30 sec and load-releasing time of 1 sec.

EXAMPLES

The present invention will be explained based on examples but embodiments of the invention are by no means limited to these.

Example 1

Preparation of Support for Photographic Use

A PET resin was obtained as follows.

PET Resin

To 100 parts by weight of dimethyl terephthalate and 65 parts by weight of ethylene glycol was added 0.05 parts by weight of magnesium acetate as a transesterification catalyst and easter interchange was carried out according to the conventional method. To the obtained product were added 0.05 parts by weight of antimony trioxide and 0.03 parts by weight of trimethyl phosphate. Subsequently, the mixture was gradually heated with evacuating, and polymerization was carried out at 280° C. and 0.5 mmHg to obtain polyethylene terephthalate (PET) resin exhibiting 0.65 of an intisic viscosity.

Using the thus obtained PET resin, a biaxially stretched PET film was prepared according to the following procedure.

Biaxially Stretched PET Film

PET resin pellets are dried under reduced pressure at 150° C. for 8 hrs., then melted at 300° C., extruded through a T-type die, closely brought into contact with a cooling drum maintained at 30° C. with applying static electricity, and cooled to prepare non-stretched film. Using a roll type longitudinally stretching machine, the film was longitudinally stretched by 3.3 time at a temperature of 110° C. Then, using a tenter type laterally stretching machine, the thus obtained uniaxially stretched film was laterally stretched to 50% of the total lateral stretch magnification in the first stretching zone at 90° C. and was further laterally stretched by 3.3 times in the second zone at 100° C. The stretched film was thermally treated at 70° C. for 2 sec., then thermally fixed at 150° C. for 5 sec in the first fixing zone and further thermally relaxed at 220° C. for 15 sec. The film was further subjected to thermal relaxation by 5% in the lateral direction at 160° C. After coming out from the tenter, the film was subjected to thermal relaxation in the longitudinal direction at 140° C., employing the difference in circumferential speed between driving rolls and cooled to room temperature in 60 sec. The film was released from a clip and wound up to obtain 125 μm thick, biaxially stretched PET film. The Tg and Tm of the PET film were 79° C. and 267° C., respectively.

Preparation of Subbed Support

Both surfaces of each of the obtained PET film was subjected to corona discharging at 8 w/m$^2$·min. Onto the surface of one side, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of n-butyl acrylate (40 weight %), styrene (20 weight %) and glycidyl methacrylate (40 weight %) | 270 g |
| Latex solution (solid 30%) of a copolymer consisting of n-butyl acrylate (2 weight %), styrene (59 weight %) and glycidyl methacrylate (39 weight %) | 150 g |
| Silica particles (av. size of 3 μm) | 0.07 g |
| (C-6) | 0.6 g |
| Water to make | 1 liter |
| **Subbing Coating Composition b-1** | |
| $SnO_2$/Sb (9/1 by weight, av. Size 0.18 μm) | 200 mg/m$^2$ |
| Latex liquid (solid 30%) of a copolymer consisting of n-butyl acrylate (30 weight %) styrene (20 weight %) glycidyl acrylate (40 weight %) | 270 g |
| (C-6) | 0.6 g |
| Water to make | 1 liter |

Subsequently, the surface of Subbing Layer B-1 were subjected to corona discharging with 8 w/m$^2$·minute. Onto the Subbing Layer B-1, the upper subbing layer coating composition b-2 was applied so at to form a dried layer thickness of 0.4 μm, which was designated Subbing Upper Layer B-2.

| | |
|---|---|
| Latex solution (solid 30%) of a copolymer consisting of n-butyl acrylate (10 weight %), t-butyl acrylate (35 weight %) styrene (25 weight %) and 2-hydroxy ethyl acrylate (30 weight %) | 140 g |
| Silica particles (av. size 3 $\mu$m) | 0.07 g |
| Water to make | 1 liter |

(C-1)

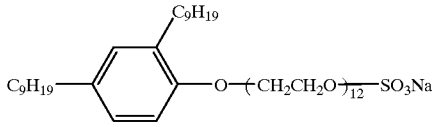

(C-2)

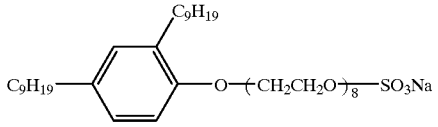

(C-3)

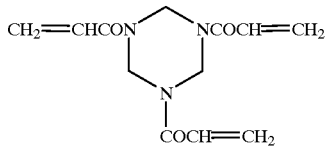

(C-4)

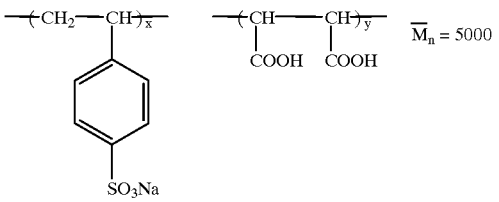

($\overline{M}_n$ is a number average molecular weight)
x:y = 75:25 (weight ratio)

(C-5)

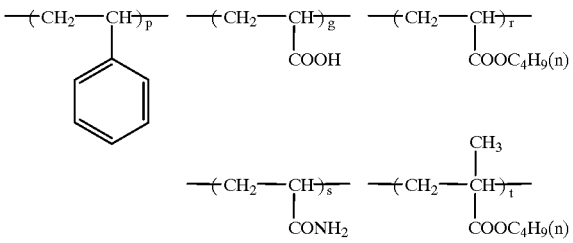

p:g:r:s:t = 40:5:10:5:40 (weight ratio)

-continued (C-6)

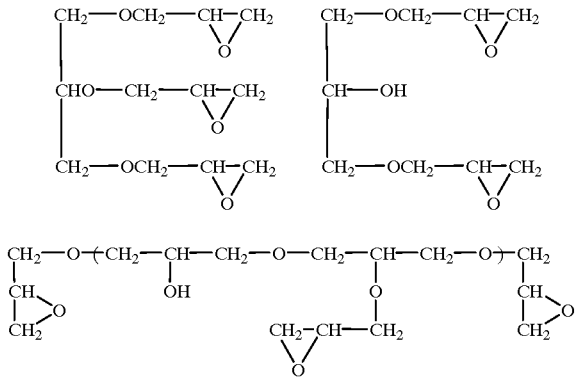

Mixture consisting of the three compounds illustrated above

Thermal Treatment of Support

The subbed support was subjected to the thermal treatment in the thermal treatment zone (a total length of 200 m) at a temperature and a transport speed under tension, as shown in Table 1. The thermally treated support was cooled at a rate of 10° C./min under a tension as shown in Table 1 and wound up at a tension of 30 kg/mm$^2$.

Preparation of Photothermographic Material

Preparation of Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing sodium chloride, potassium bromide, potassium iodide (in a molar ratio of 60/38/2), and $1\times10^{-6}$ mol/mol Ag of $[Ir(NO)Cl_5]$ and $1\times10^{-6}$ mol/mol Ag of rhodium chloride were added by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromochloride grains having an average grain size of 0.06 $\mu$m, a variation coefficient of the projection area equivalent diameter of 10 percent, and the proportion of the {100} face of 87 percent. The resulting emulsion was flocculated to remove soluble salts, employing a flocculating agent. Then, 0.1 g of phenoxyethanol was added thereto and the pH and pAg were adjusted to 5.9 and 7.5, respectively to obtain silver halide emulsion A.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. for 30 min. to obtain an aqueous sodium behenate solution.

Preparation of Pre-formed Emulsion of Silver Behenate and Silver Halide Emulsion A To the aqueous sodium behenate solution described above was added 15.1 g of silver halide emulsion A. After adjusting the pH to 8.1 with aqueous sodium hydroxide, 147 ml of aqueous 1M silver nitrate solution was added thereto in 7 min and after stirring for 20 min., soluble salts were removed by ultrafiltration. Thus obtained silver behenate was comprised of monodisperse particles having an average particle size of 0.8 $\mu$m and a monodisperse degree (i.e., variation coefficient of particle size) of 8%. After forming flock of the dispersion, water was removed therefrom and after washing and removal of water were repeated six times, drying was conducted.

Preparation of Photosensitive Emulsion

To a half of the thus prepared pre-formed emulsion were gradually added 544 g of methyl ethyl ketone solution of 17 wt % polyvinyl butyral (average molecular weight of 3,000) and 107 g of toluene. Further, the mixture was dispersed by a media dispersing machine using 0.5 mm $ZrO_2$ beads mill and at 4,000 psi and 30° C. for 10 min.

On each of the thermally treated support shown in Table, the following layers were simultaneously coated and dried at 80° C. for 10 min to prepare photothermographic material samples 101 to 105.

Back Coating

On the B-1 layer of the support, the following composition was coated.

| | |
|---|---|
| Cellulose acetate-butylate (10% methyl ethyl ketone solution) | 15 ml/m$^2$ |
| Dye-A | 7 mg/m$^2$ |
| Dye-B | 7 mg/m$^2$ |
| Matting agent: monodisperse silica having a monodisperse degree of 15% and average size of 8 $\mu$m | 90 mg/m$^2$ |
| Fluorinated surfactant $C_8F_{17}(CH_2CH_2O)_{12}C_8H_{17}$ | 50 mg/m$^2$ |
| Fluorinated surfactant $C_9F_{19}$—$C_6H_4$—$SO_3Na$ | 10 mg/m$^2$ |

Dye-A

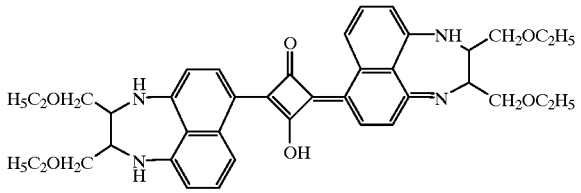

Dye-B

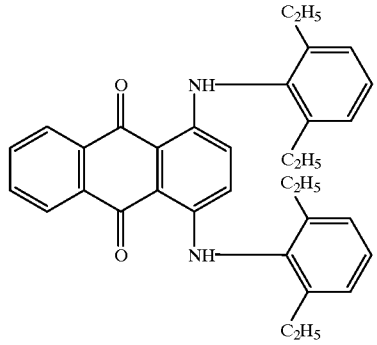

On the sub-layer A-1 side of the support, a photosensitive layer having the following composition was coated so as to have silver coverage of 2.4 g/m$^2$.

Photosensitive Layer 1

| Photosensitive layer coating solution | |
|---|---|
| Photosensitive emulsion | 240 g |
| Sensitizing dye (0.1% methanol solution) | 1.7 ml |
| Pyridinium bromide perbromide (6% methanol solution) | 3 ml |
| Calcium bromide (0.1% methanol solution) | 1.7 ml |
| Oxidizing agent (10% methanol solution) | 1.2 ml |
| 2-(4-Chlorobenzoyl)-benzoic acid (12% methanol solution) | 9.2 ml |
| 2-Mercaptobenzimidazole (1% methanol solution) | 11 ml |
| Tribromethylsulfoquinoline (5% methanol solution) | 17 ml |
| Hydrazine derivative H-26 | 0.4 g |
| Nucleation promoting agent P-51 | 0.3 g |
| Phthalazinone | 0.6 g |
| 4-Methylphthalic acid | 0.25 g |
| Tetrachlorophthalic acid | 0.2 g |
| Calcium carbonate (av. Size of 3 μm) | 0.1 g |
| 1,1-bis (2-hydroxy-3,5-dimethylphenyl)-methylpropane (20% methanol solution) | 20.5 ml |
| Isocyanate compound (Desmodur N3300, Available from Movey Corp.) | 0.5 g |
| Potasium ethyl(a-cyano-β-hydroxyacrylate) | 0.5 g |

Sensitizing dye

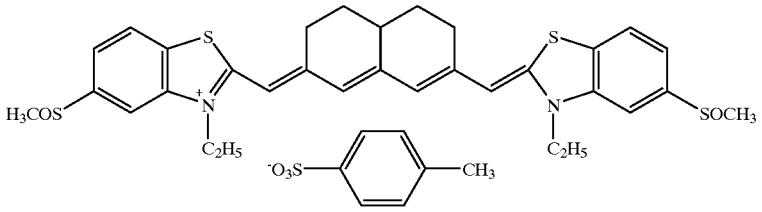

Oxidizing agent

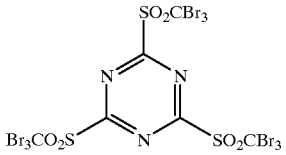

Surface Protective Layer

The following composition was coated on the photosensitive layer simultaneously therewith.

| | |
|---|---|
| Acetone | 5 ml/m$^2$ |
| Methyl ethyl ketone | 21 ml/m$^2$ |
| Cellulose acetate | 2.3 g/m$^2$ |
| Methanol | 7 ml/m$^2$ |
| Phthalazinone | 250 mg/m$^2$ |
| Matting agent, monodisperse silica having monodispersity of 10% and a mean size of 4 μm | 5 mg/m$^2$ |
| $CH_2{=}CHSO_2CH_2CH_2OCH_2CH_2SO_2CH{=}CH_2$ | 35 mg/m$^2$ |
| Fluorinated surfactant $Cl_{12}F_{25}(CH_2CH_2O)_{10}Cl_2F_{25}$ | 10 mg/m$^2$ |
| Surfactant $C_9H_{19}$—$C_6H_4$—$SO_3Na$ | 10 mg/m$^2$ |

After removing binder of each sample, electronmicroscopic observation by the replica method proved that organic salt grains were monodisperse grains of a monodisperse degree of 5% and 90% of the total grains were accounted for by tabular grains having a major axis of 0.5±0.05 μm, a minor axis of 0.4±0.05 μm and a thickness of 0.01 μm. The thus coated photothermographic material samples were each made into a roll form of 590 mm×61 m and packaged in an ambient light handleable form.

Exposure and Processing

The thus prepared photothermographic material samples were each cut to a size of 590×440 mm and subjected to overall exposure to light using an image-setter installed with 780 nm semiconductor laser, Dolev 2 dry (inner drum system, available from Cytex Co.). Exposed samples were processed using a thermal processor, as shown in FIG. 1, in which the 590 mm width was in accord with the machine direction.

Thermal Processor

FIG. 1 illustrates a sectional view of a thermal processor. The processor comprises a pre-heating section provided with plural heated rollers C1 (which also function as transport rollers) and rollers C2 made of SUS stainless steel and heated by a heater; a heat-developing section D provided with plate heaters C3 comprised of flocked (i.e., velvet-surface) stainless steel plate and rollers C4 made of SUS stainless steel and heated by a heater; and a cooling section R provided with plural transport rollers.

Figure 2:
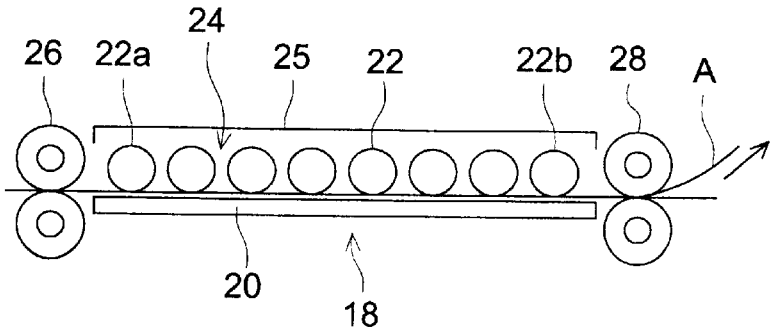
FIG. 2 illustrates a sectional view of a thermal processor used in this invention.

FIG. 2 illustrates a sectional view of the heat-developing section. The heat-developing section is provided with plate heater 20 of flocked stainless steel plate heated to the optimal temperature to develop photothermographic material A; transport means 26 for moving the photothermographic material relative to the plate heater 20, while in contact with the plate heater 20; and pressure rollers 22 as a means for pressing the back side of the sheet A to the side in contact with plate heater 20 to undergo heat-transfer of from plate heater 20 to sheet A. Plate heater 20 is a tabular plate, which is a planar heating member having an internal heating body of nichrome wire arranged in a planar form and which maintains a photothermographiq material at the optimal developing temperature. A photothermographic material is introduced to the thermal processor via paired rollers 26 driven by a driving apparatus, and is allowed to pass through between a silicone rubber pressure roller 22 and plate heater 20 by driving transport of paired, opposed rollers 26, whereby the photothermographic material is subjected to a thermal treatment. The thermally treated photothermographic material is discharged through guide roller 28. To avoid abrasion marks, the back side of the photothermographic material is brought into contact with plate heater 20. Pressure rollers 22 are in contact with one side of plate heater 20, at a space less than the thickness of the photothermographic material sheet and are arranged at prescribed intervals in the direction of the total length.of plate heater 20. Sheet transporting route 24 is formed by pressure rollers 22 and plate heater 20. Paired and opposed supplying rollers 26 and discharge rollers 28 are arranged at opposed ends of the transporting route.

From insertion opening I, photothermographic material is introduced, passing through pre-heating section P, heat-developing section D and cooling section R and being discharged from discharge opening O. For example, the temperature of the pre-heating section is 100° C. and the temperature of the heat-developing section is 120° C.; the processing time during pre-heating and during heat developing is 20 sec and 15 sec, respectively; while the line-speed is 20 mm/sec.

Evaluation of Abrasion Mark of Support

Supports which were subjected to the transport thermal treatment described earlier were each cut to a 1 m square and visually evaluated with respect to the number of abrasion marks on the surface, based on the following criteria:

A; no mark observed,

B; 1 to 3 marks observed,

C; 4 to 7 marks observed, and

D; 8 or more marks observed, in which A and B are acceptable in practical use.

Evaluation results are shown in Table 1.

TABLE 1

| | Thermal Treatment | | | | | |
|---|---|---|---|---|---|---|
| Sample | Transport Speed (m/min) | Temp. (° C.) | Tension (kg/cm$^2$) | Tension Variation | Tension at Cooling (kg/cm$^2$) | Abrasion Mark of Support |
| Comp. 1 | 20 | 125 | 3 | Const.*1 | 12 | D |
| Comp. 2 | 40 | 140 | 35 | Const. | 12 | B |
| Comp. 3 | 30 | 130 | 40→5 | Contin.*2 | 12 | C |
| Comp. 4 | 20 | 125 | 40→5 | 2-Step*3 | 12 | D |
| Comp. 5 | 50 | 140 | 50→20→5 | 3-Step*4 | 12 | D |
| Inv. 1 | 50 | 140 | 12 | Const. | 12 | B |
| Inv. 2 | 20 | 140 | 7 | Const. | 12 | B |
| Inv. 3 | 30 | 125 | 12→3 | Contin. | 12 | B |
| Inv. 4 | 20 | 140 | 6→3 | Contin. | 3→2 | A |
| Inv. 5 | 20 | 125 | 15→5 | 2-Step | 12 | B |
| Inv. 6 | 20 | 140 | 7 | Const. | 7→3 | C |
| Inv. 7 | 50 | 140 | 15→10→5 | 3-Step | 5→2 | B |

*1: Maintained under a constant tension
*2: Tension was continuously varied
*3: Tension was varied two-stepwise
*4: Tension was varied three-stepwise.

In Sample 3, 8 and 9, the tension was continuously varied from 40 to 5, 12 to 3 and 6 to 3 kg/m$^2$, respectively. In Samples 4 and 10, the tension was two-stepwise varied from 40 to 5 and 15 50 5 kg/m$^2$, respectively. Similarly, in Samples 5 and 12, the tension was three-stepwise varied from 50 to 20 and further to 5, and 15 to 10 and further to 5 kg/cm$^2$, respectively.

Example 2

Using supports used in samples 2 and 7 of Example 1 and coating solutions used in Example 1, photothermographic materials were prepared in a manner similar to Example 1. Thus, photothermographic material Sample 1 was prepared using the same coating solutions as in Example 1. Photothermographic material sample 2 was prepared similarly to Sample 1, provided that the amount of the matting agent used in the surface protective layer was changed to 50 mg/m$^2$ and the total amount of fluorinated surfactants used in the back layer was changed to 60 mg/m$^2$. Further, photothermographic materials were subjected to a thermal treatment at 60° C. for 10 min.

The matting degree, coefficient of dynamic friction and indentation hardness of a photothermographic material Samples 1 and 2 are shown in Table 3, with respect to the photosensitive layer-side (denoted as EC) and backing layer side (denoted as BC).

Thermal processing was carried out using a thermal processor as shown in FIGS. 1 and 2, provided that the rotation number and torque of transport rollers and a spring strength of the nip were adjusted so as to give a pressure of the transport medium onto the photothermographic material, as shown in Table 2. Further, hardness, length and shape of the flock on the pre-heater surface were varied so as to give a matting degree. as shown in Table 2.

The thus prepared photothermographic material samples were thermally processed using a thermal processor under the conditions described above and evaluated with respect to dimensional change between before and after thermal processing and flatness.

Evaluation of Dimensional Change of Photothermographic Material

Using the image-setter described above, a portion of 5 cm (longitudinal direction)×5 cm (width direction) of each photothermographic material sheet was subjected to overall exposure and thermally processed with the thermal processor described above. Thermally processed samples each were aged at 23° C. for a period of 1 day and then measured with respect to edge lengths in the longitudinal and width directions of the square image. The difference in edge length between before and after being thermally processed was represented in terms of percentage, based on the edge length of 5 cm before being thermally processed. Dimensional change was evaluated based on the following criteria:

A; not more than 0.03%,

B; more than 0.03% but not less than 0.08%,

C; more than 0.08% but not less than 0.12%, and

D; more than 0.12%.

Evaluation of Flatness

A thermally processed photothermographic material sample of a 590 mm×440 mm size was placed on a table superior in flatness and visually evaluated with respect to flatness of a bass, based on the following criteria:

A: superior flatness and closely adhered to the table,

B: good flatness and almost adhered to the table,

C: some wrinkles of the base observed, and

D: waved all over due to winkles of the base.

TABLE 2

| | | Photo-sensitive Layer | | Thermal Processing | | | | |
|---|---|---|---|---|---|---|---|---|
| | | Coating | | | Matting | | | |
| Sample | Support | Temp (° C.) | Tension (kg/cm$^2$) | Pressure (kgf/cm$^2$) | Degree (mmHg) | Phot. Mat. | Dimensional Change | Flatness |
| 21 (Comp) | 2 | 80 | 35 | 15.0 | 20 | 1 | D | D |
| 22 (Inv) | 2 | 80 | 10 | 12.0 | 25 | 1 | B | C |
| 23 (Inv) | 2 | 75 | 10 | 1.1 | 60 | 1 | A | B |
| 24 (Inv) | 7 | 80 | 8 | 12.0 | 320 | 2 | A | A |
| 25 (Inv) | 7 | 80 | 5 | 1.5 | 280 | 2 | A | A |
| 26 (Comp) | 2 | 80 | 35 | 15 | 20 | 1 | D | D |
| 27 (Comp) | 2 | 135 | 42 | 14 | 100 | 1 | D | C |
| 28 (Comp) | 2 | 140 | 0.001 | 15.0 | 20 | 1 | D | D |
| 29 (Inv) | 2 | 80 | 10 | 12.0 | 25 | 1 | B | C |
| 30 (Inv) | 2 | 75 | 10 | 1.1 | 60 | 1 | A | B |
| 31 (Inv) | 7 | 80 | 8 | 12.0 | 320 | 2 | A | A |
| 32 (Inv) | 7 | 80 | 5 | 1.5 | 280 | 2 | A | A |
| 33 (Inv) | 9 | 65 | 9 | 3.0 | 30 | 1 | A | B |
| 34 (Inv) | 9 | 90 | 3 | 0.6 | 280 | 2 | A | A |

TABLE 3

| Photo. | Matting Degree | | Dynamic Friction | | Hardness | |
|---|---|---|---|---|---|---|
| Material | EC | BC | EC | BC | EC | BC |
| 1 | 20 | 50 | 0.10 | 0.54 | 12.0 | 25.0 |
| 2 | 80 | 60 | 0.32 | 0.27 | 18.0 | 32.0 |

As can be seen from the Tables, photothermographic materials prepared according to this invention exhibited superior heat dimensional stability and superior surface quality.

What is claimed is:

1. A method of preparing a photothermographic material comprising a support having thereon at least a layer, the method comprising the steps of:

coating a coating solution containing an organic silver salt, a photosensitive silver halide and a reducing agent on the support to form a coated material and subjecting the coated material to a thermal treatment at a temperature of 40 to 120° C. under a tension of 0.01 to 30 kg/cm$^2$.

2. The method of claim 1, wherein the coating solution further contains a hydrazine derivative.

3. The method of claim 1, wherein the tension is 5 to 10 kg/cm$^2$.

4. The method of claim 1, wherein the coating solution is coated on the support which was previously subjected to a thermal treatment at a temperature of not lower than a glass transition temperature of the support and not higher than a melting temperature of the support, while being transported under a tension of 6 to 30 kg/cm$^2$.

5. The method of claim 4, wherein the support is transported, while the tension is varied, the variation range of the tension is 6 to 20 kg/cm$^2$.

6. The method of claim 4, wherein the support is transported, while the tension is varied, the difference in tension between at the start of the thermal treatment and at the completion of the thermal treatment.

7. The method of claim 6, wherein a tension at the start of the thermal treatment is larger than that at the completion of the thermal treatment.

8. The method of claim 4, wherein after completion of the thermal treatment, the support is continuously cooled to room temperature.

9. The method of claim 7, wherein the support is subjected to the thermal treatment for a period of 0.2 to 30 min.

10. The method of claim 7, wherein the support contains at least 50% by weight of polyethylene terephthalate or polyethylene naphthalate.

11. The method of claim 3, wherein the coated material is subjected to the thermal treatment for a period of 2 to 60 min.

12. The method of claim 3, wherein the coated material is subjected to the thermal treatment at a temperature of 50 to 100° C.

13. The method of claim 1, wherein the organic silver salt is a silver salt of a long chain fatty acid or a silver salt of a nitrogen containing heterocyclic compound.

14. The method of claim 13, wherein the organic silver salt silver behenate, silver stearate or silver arachidate.

* * * * *